US005286213A

United States Patent [19]

Altergott et al.

[11] Patent Number: 5,286,213

[45] Date of Patent: Feb. 15, 1994

[54] LOCKING RECEPTACLE

[76] Inventors: Raymond Altergott, 5110 N. Kildare Ave., Chicago, Ill. 60630; William E. Kummetz, 1239 Old Mill Ln., Elk Grove, Ill. 60007

[21] Appl. No.: 9,981

[22] Filed: Jan. 27, 1993

[51] Int. Cl.[5] ..... H01R 13/44

[52] U.S. Cl. ..... 439/139; 200/51.09; 439/188; 439/263; 439/346

[58] Field of Search ..... 439/95, 136, 137, 139, 439/142, 144, 147, 188, 263, 346; 200/51.09

[56] References Cited

U.S. PATENT DOCUMENTS 1,890,484 10/1929 Allehic .
1,957,733 5/1934 Good .
2,026,755 6/1928 Stem .
2,643,364 6/1953 Nauslar .
2,704,831 3/1955 Smith .
2,771,590 11/1956 Nauslar .
3,066,276 11/1962 Hubbell .
3,233,204 10/1963 Devore .
3,611,255 10/1971 Shreyer .
3,668,607 6/1972 Farnworth .
3,699,285 10/1978 Leatherman .
3,982,084 9/1976 Cooperstein .
4,548,455 10/1985 Ezure .
4,909,749 3/1990 Long .

*Primary Examiner*—Paula A. Bradley
*Attorney, Agent, or Firm*—John G. Tolomei

[57] ABSTRACT

An outlet arrangement is disclosed that positively engages the straight terminal blades of most standard plugs. A positive clamping action about the broad sides of the terminal blade holds the plug into the outlet. The user controls the clamping action by moving the plug or some other control element relative to the outlet. The clamping action is unlike the usual friction force provided by most outlets since the clamping force provided by this invention can hold the plug in place whereas the force provided by standard outlets permits easy withdrawal of the plug from the outlet. This invention uses the fact that most plugs have a small depression or hole near the end of its blades. This invention also controls the electrical connection of the terminal contacts with the movement of the locking element to prevent shocks upon initial insertion of the plug into the receptacle.

6 Claims, 3 Drawing Sheets

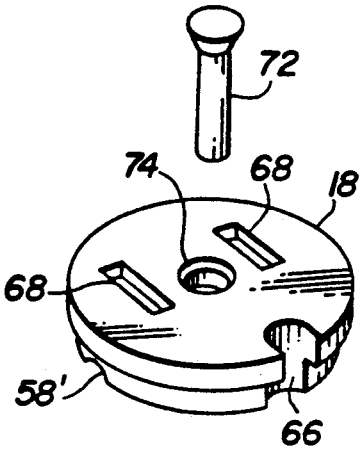
Fig. 3
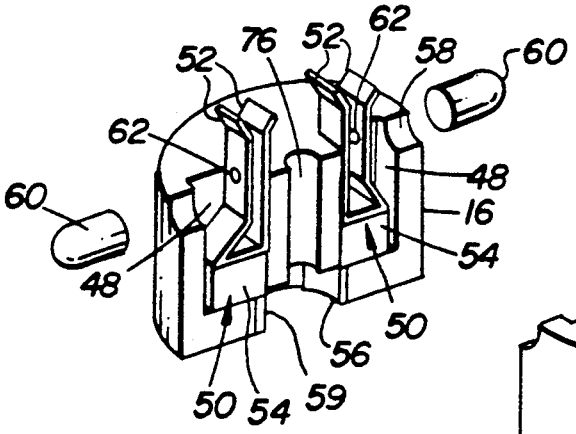
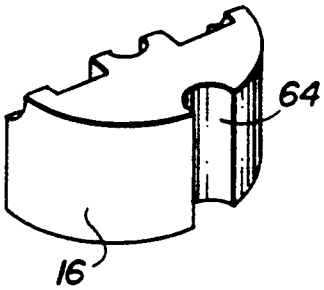
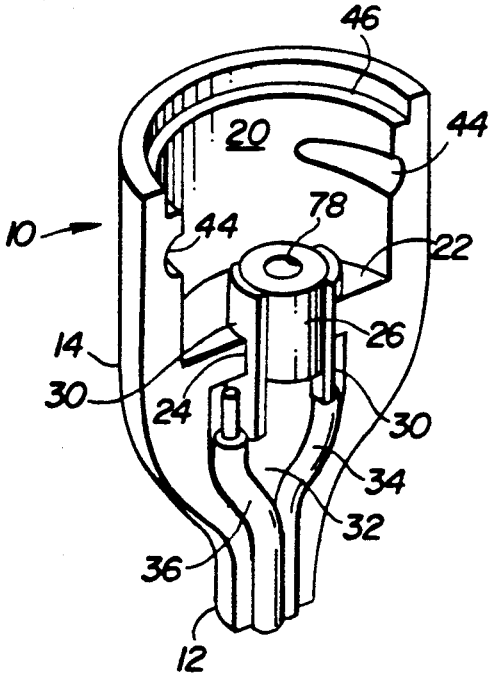
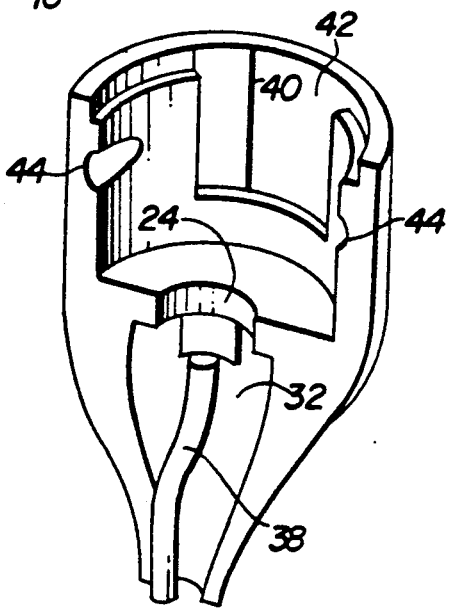

LOCKING RECEPTACLE

BACKGROUND OF THE INVENTION

1. FIELD OF THE INVENTION

This invention relates to female receptacles at the ends of extension cords or wall outlets commonly used for suppling low wattage electrical power to household appliances and power tools.

2. DESCRIPTION OF THE PRIOR ART

A wide variety of receptacles are known to provide electrical contact between male electrical connectors having blade type terminals, commonly referred to as plugs, and female receptacles for receiving the blade type terminals, commonly referred to as outlets.

The most common household outlet has a pair of terminal contacts that receives the blade type terminal and are biased into contact with the blade terminal. The biasing force of the terminal contacts against the terminal blades is relatively light and the plug is easily inserted or removed from the outlet. Following installation, the terminal contacts remain in electrical connection with the power supply source.

A wide variety of other outlets designs satisfy, to varying degrees, the desire to more safely and securely connect a plug in an outlet. Again, in its basic form an electrical outlet has a pair of spring biased contact plates that receive the blade type terminals of the plug and frictionally hold the terminal in place against a relatively low withdrawal force. The low withdrawal force creates inconvenience where an inadvertent tug on an extension cord will pull the plug from the outlet. Continually powered outlets also pose the danger of electrical shock by accidental contact with the blades of the plug as it is inserted into the terminal or the contact of the live terminals with conductive material that was unknowingly placed into the outlet.

A number of the patents are directed to providing a safe outlet. U.S. Pat. No. 3,982,084 is directed solely to a safety receptacle and uses a nonconducting center prong to push internal electrical contacts into the conducting side prongs. U.S. Pat. No. 3,699,285 is similar in function and operation to the '084 patent and apart from making a good electrical connection is directed on to safety considerations of and outlet. The '285 patent uses a ground plug to act as a switch and close a circuit with the prongs as the prongs are inserted into the receptacle.

A number of other outlet arrangements will inhibit or prevent withdrawal of the plug from the outlet. U.S. Pat. No. 3,611,255 uses a locking ring to hold male and female receptacles together in a weather proof receptacle arrangement. U.S. Pat. No. 4,548,455 discloses a connector set with a relatively complex locking system having protrusions independent of the receptacle blades that are needed to achieve locking of the receptacle halves. U.S. Pat. Nos. 3,066,276 and 3,233,204 show the well known arrangement of arcuate prongs that are inserted into and rotated about a corresponding female receptacle to lock projecting portions of the prongs under retaining ledges defined by the receptacle. The '276 patent improves on the operation of the standard arcuate prong device by automatically rotating a portion of the female receptacle so that the male plug is locked into place by simple axial insertion of the plug. The '204 patent is similar in function to the '276 patent, but uses an internal camming device to automatically engage the prong projections with only a longitudinal movement of the male plug into the receptacle. U.S. Pat. Nos. 2,771,590 and 2,026,755 also use hooked or notched blades to furnish a locking function where the male plug is rotated relative to the female receptacle in order to lock or unlock the receptacles. Other arrangements that utilize hooked blades to lock receptacles are disclosed in U.S. Pat. Nos. 1,957,773 and 1,890,484. In the '773 and '484 patents, hook portions at the ends of the male connectors engage a cooperating ledge in a female receptacle and the plug is disengaged from the receptacle by displacing one or more of the hooks toward the center of the male plug.

It is also known to combine the locking action of a receptacle with a safe design to provide both functions in a single unit. U.S. Pat. No. 2,643,364 discloses a combination shockproof and secure electrical plug and receptacle set. In order to provide the locking function, the '364 patent employs special hooked blades that have a bottom projection to engage a ledge in the female receptacle.

One problem with the locking receptacles known to date is that they generally require specially designed terminals on the plugs. The prior art outlets can only provide the locking function when the blades of the plug are of a particular type that will cooperate with the female receptacle. These locking outlets will not positively engage the ordinary straight terminal blades of most plugs. Therefore locking outlets of the prior art offer limited utility for the average consumer.

BRIEF DESCRIPTION OF THE INVENTION

It is an object of this invention to provide an outlet that will securely connect to most power cords.

It is a further object of this invention to provide an outlet that will positively engage a plug to prevent withdrawal of the plug.

A yet further object of this invention is to provide an outlet that positively engages the terminal blades of most plugs and protects against shock while inserting the plug into the outlet.

This invention is an outlet that positively engages the straight terminal blades of most standard plugs. A positive clamping action about the broad sides of the terminal blade holds the plug into the outlet. The user controls the clamping action by moving the plug or some other control relative to the outlet. The clamping action is unlike the usual friction force provided by most outlet since the clamping force provided by this invention can hold the plug in place whereas the force provided by standard outlets permits easy withdrawal of the plug from the outlet.

It was also discovered that most plugs have a design that facilitates engagement by this clamping action. A typical terminal blade has a small depression or hole near its end. In one form of this invention the clamping action urges a nub or pin into the depression at the end of the pin thereby securing the terminal blade into the outlet. Since most of the terminal blades have these small holes or depression the clamping action positively engages the outlet with the terminal blade to prevent removal of the plug prior to removal of the clamping force.

The clamping force is applied to the plug by a locking step. Thus, clamping does not occur until a positive step is taken to secure the plug in the outlet by movement of a locking element. It is contemplated that this positive step will can consist of rotation of the plug relative to the outlet or the movement of a locking lever attached to the outlet.

It has also been found that by controlling the electrical connection of the terminal contacts with the movement of the locking element, the outlet of this invention can prevent shocks upon initial insertion of the plug into the receptacle. In such an arrangement the terminal contacts remain open until the locking movement takes place and closes the circuit between the power source and the terminal contacts.

Accordingly in a broad embodiment this invention is a female electrical receptacle for receiving a male receptacle having blade type terminals. The female receptacle includes a receptacle housing, at least one pair of terminal contacts within the housing for contacting a pair of terminal blades and means in the housing for clamping at least one of the terminal blades. The means for clamping engages the terminal blade by acting on the broad side of the terminal blade.

In a more limited embodiment this invention is a female electrical receptacle for receiving a male receptacle having blade type terminals. The terminals define depressions at the ends of the broad side of the terminal blades. The female receptacle includes a receptacle housing and at least one pair of terminal contacts within the housing for contacting a pair of terminal blades. The housing also includes means for urging a nub against the broad side of a terminal blade and into the depression of at least one of the terminal blades.

In a yet more limited embodiment this invention is a female electrical receptacle for receiving a male receptacle having blade type terminals that define depressions at the end of the broad side of said terminal blades. The receptacle includes a receptacle housing and a terminal block pivotally mounted in the housing for relative rotation with respect to the housing, the terminal block having a top surface for receiving a pair of terminal blades. At least one pair of terminal contacts located within the terminal block contacts the pair of terminal blades. A nub is located on at least one of the terminal contacts and engages a depression in the broad side of the terminal blade by pressure from a ramp formed in the housing. The ramp cooperates with the terminal contact to urge the terminal contact into contact with the terminal blade and the nub into engagement with the depression when the terminal block is rotated relative to the housing. The housing also includes a supply contact arranged to electrically contact one of the terminal contacts when the terminal block is rotated to urge the terminal contact into contact with the terminal blade.

Other objects, embodiments and details of this invention are disclosed in the following detailed description of this invention.

BRIEF DESCRIPTION OF THE DRAWINGS

FIG. 3 is an exploded view of the outlet of FIGS. 1 and 2.

DETAILED DESCRIPTION OF THE INVENTION

The outlet of this invention provides a secure means of connecting a plug to an outlet. The invention can be used with any type of standard electrical plug having straight terminal blades. The invention provides the most advantage when the terminal blades have holes or depressions in their ends that allow the receptacle of this invention to positively engage the terminal blades. However, this invention can still be used with terminal blades that do not have holes or depressions. The clamping action provided by the arrangement of this invention will also lock straight terminal blades into the outlet.

The necessary action to lock the plug in the outlet can also improve the safety of the receptacle. In a particular arrangement the locking action simultaneously brings the terminal contacts into electrical connection with the power supply.

A better understanding of the details of the invention can be obtained by reference to the drawings that show a particular arrangement of the outlet. However the further description of this invention in the context of a particular embodiment is not meant to limit the invention to the details disclosed therein.

Figure 1:
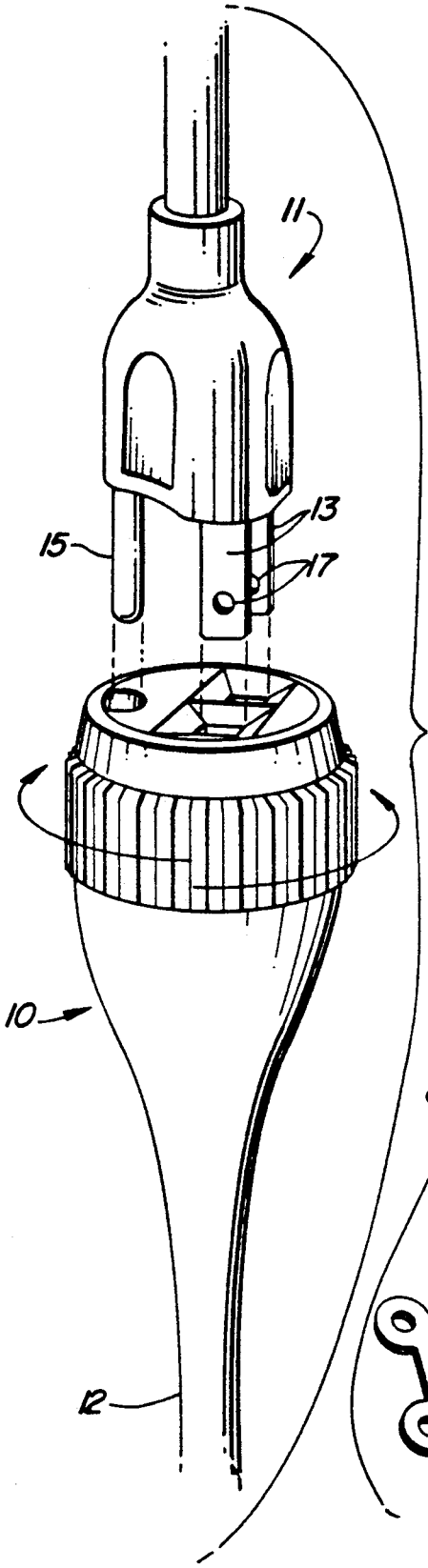
FIG. 1 view of one form of the outlet of this invention and a male plug for insertion therein.

FIG. 1 shows and outlet 10 attached to a power supply cord 12 and a male plug 11 for insertion therein. The power supply cord represents a typical extension cord having positive, neutral and ground wires. It should be noted that the outlet of this invention is suitable for use in any type of outlet including wall mounted outlets as well as power cords. Male plug 11 is positioned for insertion into the receptacle 10 and has terminal blades 13 and a ground prong 15. Each of terminal blades 13 has a small hole 17 at its proximate end.

Figure 2:
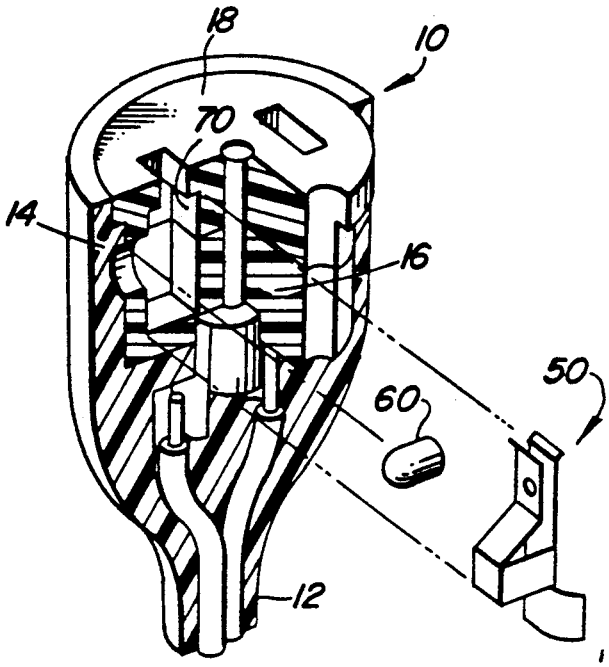
FIG. 2 is a partial section of the outlet of FIG. 1.

As shown in FIG. 2 the outlet 10 includes a housing 14, a terminal block 16, and a terminal block cover 18. Terminal block 16 and block cover 18 house a contact 50 that receives male terminal blades 13 and cooperates with a pin 60 in manner hereinafter described to lock the terminal blades 13 in the receptacle. FIG. 3 better illustrates the structure of the different parts within the receptacle.

Referring to FIG. 3, the housing defines a central cavity 20 that receives terminal block 16. The bottom of cavity 20 is defined by a surface 22 that has an opening 24 for retaining a central cylinder 26. Pressure between the cylinder 26 and the periphery of opening 24 hold a pair of power contacts 30 on opposite sides of cylinder 26. Contacts 30 extend below surface 22 into a lower cavity 32 that protects the ends of a positive lead 34, a neutral lead 36 and a ground lead 38. Positive lead 34 and neutral lead 36 attach to the depending ends of power contacts 30. Ground lead 38 attaches to a ground contact 40 that extends into a slot 42 defined along the inside of housing 14. Slot 42 receives the cylindrical ground terminal 15 of male receptacle 11. A ledge 46 borders the upper end of cavity 20 for guiding cover 18. The inner surface of housing 14 also defines a pair of ramps 44 in the form of concave slots on opposite sides for use in providing the clamping action as hereinafter described.

Terminal block 16 defines a pair of cavities 48 on opposite sides of its central axis. The terminal contact 50 is secured into each cavity 48. Each terminal contact has a pair of spaced apart plates 52 at its upper end that receive the terminal blades 13 of the plug. An integral conductive member 54 joins the spaced apart plates 52 about their bottoms and a contact tang 56 extends downward from each member 54 onto opposite sides of a cylindrical opening 59. The bottom of terminal block 16 defines cylindrical opening 59. Cylindrical opening 59 is sized to accommodate cylinder 26 and keep power contacts 30 in electrical connection with tangs 56 when the terminal block 16 is inserted into cavity 20 and contacts 30 and 56 are aligned.

A pair of slots 58 extend from the outer periphery of the sidewall of terminal block 16 into the cavity 48. Each slot receives a locking pin 60 that acts against the outer plate in each of the spaced apart plates 52 in each terminal contact 50. The pin 60 is urged, in a manner hereinafter described, into contact with the outer plate of spaced apart plates 52 to lock the terminal blade 13 into engagement with the terminal block. The inner surface of the blade can be provided with a roughened surface to increase the engagement between the terminal blade and the plate 52. In the preferred form of this invention the plate 52 has a nub 62 that extends inwardly for engaging hole or depression 17 in the blades of the terminal. Nubs 62 may be provided on one or both plates in the terminal contact 50.

The terminal block 16 also includes a slot 64 for receiving the ground terminal of plug. Terminal block cover 18 has a corresponding slot 66 for receiving the ground terminal. In addition, terminal block cover 18 has spaced apart slots 68 for receiving the terminal blades of the plug through the top of the cover. A pair of semi-circular slots 58, on the bottom of the terminal block cover act together with slots 58 in the terminal block 16 to hold the upper portion of locking pins 60 in place. (Referring to FIG. 2 the bottom of cover 18 also has two cavities 70 for receiving the upper portion of plates 52.) Extension of plates 52 into cavities 70 keeps the terminal cover plate 18 in angular alignment with the terminal block 16.

A pin 72 holds cover plate 18 and terminal block 16 in cavity 20. Pin 72 extends through a hole 74 in the center of terminal block cover 18, a hole 76 in the center of terminal block 16, and is fixed into a hole 78 in the center of cylinder 26.

When used to make a connection, the terminal blades 13 of the plug are first inserted into slots 68 and, if present, the ground terminal 15 passes into slot 66. The terminal blades 13 extend past the cover plate 18 and into contact with terminal contacts 50. Ground plug 18 also extends past the cover 18 into slot 64. When initially inserted into the terminal block, the terminal block 18 and cover plate 16 have an angular orientation in the housing 14 such that the plug is not locked into the outlet 10 and no electrical connection is made between the power supply cord 12 and the plug 11. In this position the outer ends of locking pins 60 are biased by the outer plates 52 into the deepest portion of ramps 44. The orientation of the terminal block with respect to the housing 14 orients tang contacts 56 at about 90 degrees to the supply contacts 30 and the ground terminal of the plug out of contact with the contact 40.

Rotating the plug about 30 to 90 degrees counterclockwise with respect to the housing 10 turns the terminal block 16 and the cover 18 through the same angle relative to the housing. As the terminal block turns relative to the housing, the decreasing depth of the ramps 44 pushes the locking pins 60 inward against the outer plate 52 and clamps the terminal blades of the plug into the terminal block and outlet. At the same time rotation of the terminal block relative to the housing causes tang contacts 56 to contact supply terminals 30 and close the circuit between the terminal connectors and the supply connectors. The rotation also brings the ground terminal into contact with plate 40. Rotation of the terminal block with respect to the housing is limited by contact of the ground terminal with the end of slot 42 or advancement of the locking pins 60 to the top of ramps 44.

Figure 4:
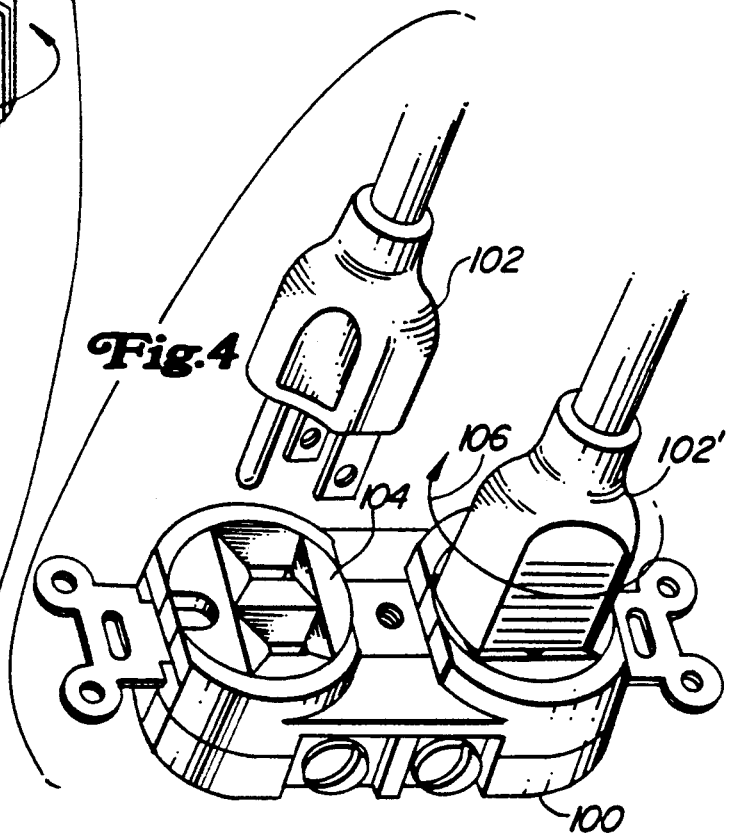
FIG. 4 is a perspective of a common wall receptacle incorporating the outlet of this invention.
Figure 5:
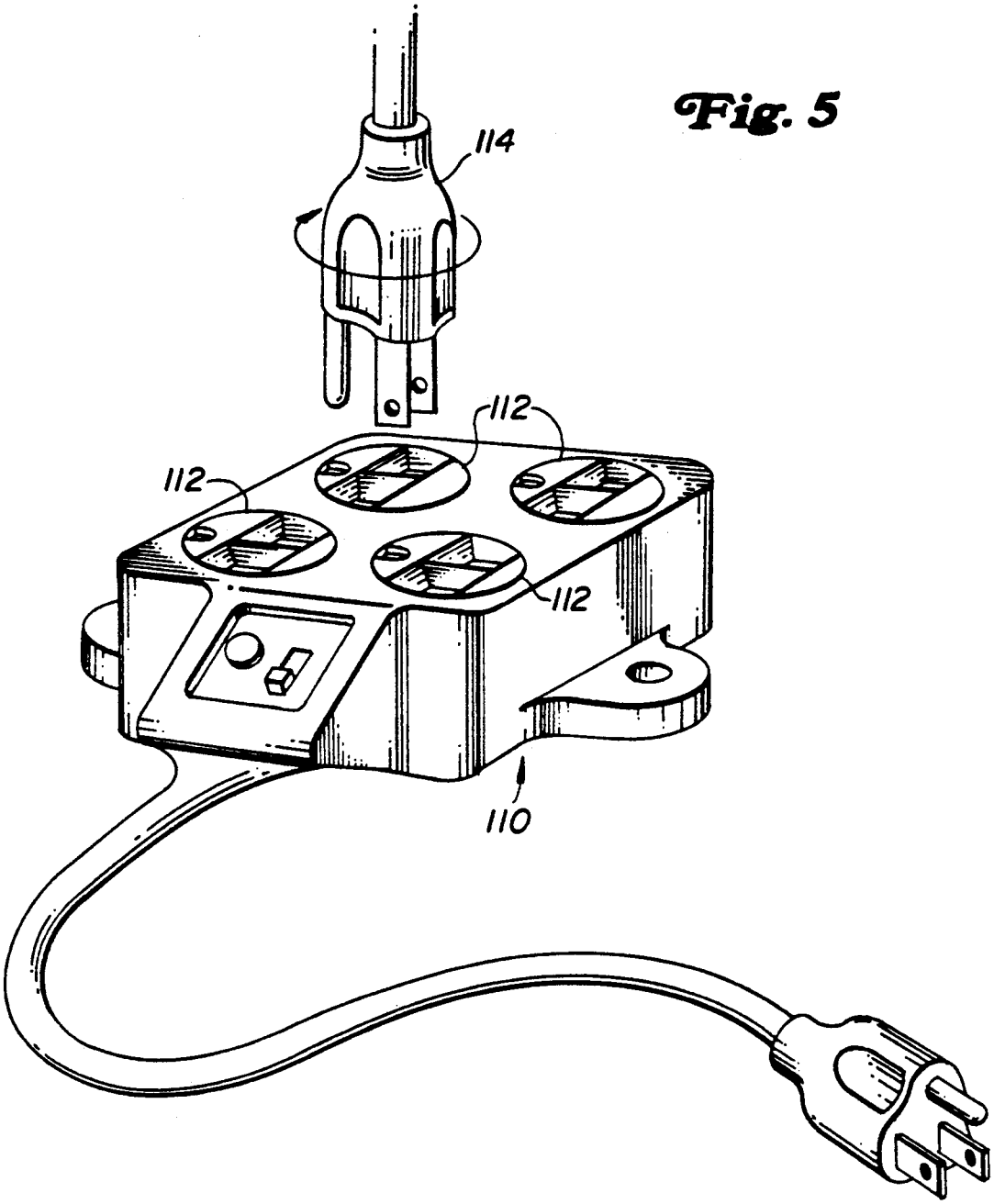
FIG. 5 is a perspective view of a four outlet extension receptacle incorporating the outlet of this invention.

This invention has been described in the context of a particular embodiment. Those skilled in the art will be aware of a number of different outlet configurations that will provide the function of this invention. FIG. 4 illustrates the incorporation of the receptacle of this invention in a duplex wall outlet 100. Again the receptacle of FIG. 4 is used by inserting the plug 102 into the face 104 of the receptacle 100 and rotating the plug 102' in the direction indicated by arrow 106. Similarly, FIG. 5 shows the use of the receptacle of this invention in molded extension box 110 having four outlets 112 for receiving a plug 114.

In addition those skilled in the art will be aware of many ways to arrange the internal of the receptacle. For example, it is within the teachings of this invention that the terminal contacts be fixed with respect to the housing and a sliding member provide ramps to clamp the terminal contacts against the terminal blades. In addition there is no need for the terminal contacts to clamp the terminal blades. The locking pins can act directly against the terminal blades to provide the clamping action. In fact in the case of terminal blades having holes through the bottom of the blades, the locking pins can extend through the holes or the terminal blades to lock the plug in the outlet. Accordingly coverage is sought for all aspects of this invention within the scope of the appended claims.

What is claimed is:

1. A female electrical receptacle for receiving a male receptacle having blade type terminals and said terminals defining depressions proximate the end of a broad side of said terminal blades, said female receptacle comprising:

a receptacle housing;

a terminal block pivotally mounted in said housing for relative rotation with respect to said housing and having a top surface for receiving a pair of terminal blades;

at least one pair of terminal contacts located within said terminal block for contacting said pair of terminal blades; a nub located on at least one of said terminal contacts for engaging a depression in the broad side of said terminal blade;

a ramp formed by said housing and cooperating with said terminal contact to urge said terminal contact into contact with said terminal blade and said nub into engagement with said depression when said terminal block is rotated relative to said housing; and, a supply contact arranged to electrically contact one of said terminal contacts when said terminal block is rotated to urge said terminal contact into contact with said terminal blade.

2. The female electrical receptacle of claim 1 wherein each of said terminal contacts comprises inner and outer contact plates positioned to receive said terminal blade there between and each of said outer contact plates has a nub defined on its surface to engage said depression.

3. The female electrical receptacle of claim 2 wherein said ramp is defined by the inner surface of said housing as a concave slot and one end of a locking pin, disposed in said terminal block, acts against the surface of said ramp and the opposite end of said locking pin acts against one of said outer contact plates.

4. The female electrical receptacle of claim 3 wherein said supply contact are disposed about opposite sides of a central cylinder fixed in said housing, a pair of recesses defined by and located on opposite sides of said terminal block house said terminal contacts and each of said terminal contacts have a tang that extends to the bottom of said terminal block to electrically contact said supply contacts when said terminal block is rotated to urge said terminal contact into contact with said terminal blade.

5. The female electrical receptacle of claim 4 wherein said receptacle includes a terminal block cover located about the open end of said housing, engaged by said terminal block to maintain angular alignment therewith and retained in said housing by a central pin that passes through said terminal block cover and said terminal block.

6. The female electrical receptacle of claim 4 wherein said terminal block has a groove on its periphery for receiving a ground terminal from a male receptacle and said housing has a ground contact located on its inner diameter for electrically contacting said ground terminal when said terminal block is rotated to urge said terminal contact into contact with said terminal blade.

* * * * *